US005139531A

United States Patent [19]

Cole et al.

[11] Patent Number: 5,139,531

[45] Date of Patent: Aug. 18, 1992

[54] FABRIC TREATMENT PROCESSES

[75] Inventors: Robert Cole, Dudley; Geoffrey Hand, Halesowen, both of England

[73] Assignee: Albright & Wilson Limited, West Midlands, United Kingdom

[21] Appl. No.: 640,529

[22] Filed: Jan. 11, 1991

Related U.S. Application Data

[63] Continuation of Ser. No. 518,224, May 3, 1990, abandoned, which is a continuation of Ser. No. 379,657, Jul. 11, 1989, abandoned, which is a continuation of Ser. No. 256,077, Sep. 29, 1988, abandoned, which is a continuation of Ser. No. 107,787, Oct. 13, 1987, abandoned.

[30] Foreign Application Priority Data

Jan. 19, 1987 [GB] United Kingdom ..... 8701074

[51] Int. Cl.[5] ..... D06M 13/40; D06M 13/54; D06M 15/43

[52] U.S. Cl. ..... 8/127.1; 8/116.1; 8/184; 8/185; 8/195; 427/341; 427/342

[58] Field of Search ..... 8/127.1, 281, 116.1, 8/184, 185, 195; 427/341, 342

[56] References Cited

U.S. PATENT DOCUMENTS

| | | | |
|---|---|---|---|
| 2,668,096 | 2/1954 | Reeves et al. | 8/127.1 X |
| 4,156,747 | 5/1979 | Wagner | 427/389 X |
| 4,451,262 | 5/1984 | Mayer et al. | 8/125 |
| 4,483,689 | 11/1984 | Welch | 8/194 X |
| 4,494,951 | 1/1985 | Cole et al. | 8/195 |

FOREIGN PATENT DOCUMENTS

| | | |
|---|---|---|
| 1061134 | 3/1967 | United Kingdom . |
| 1065547 | 4/1967 | United Kingdom . |
| 1390233 | 4/1975 | United Kingdom . |

OTHER PUBLICATIONS

Rowland and Mason, Textile Research Journal, 1977, pp. 365–371 and 721–728.

*Primary Examiner*—Michael Lusignan

*Attorney, Agent, or Firm*—Frishauf, Holtz, Goodman & Woodward

[57] ABSTRACT

Flame retardant cellulosic fabrics having reduced shrinkage are obtained by treatment involving reaction of fabric with a non self-condensing methylolamide under aqueous acid conditions, followed by treatment of fabric with tetrakis hydroxylmethyl phosphonium compound or condensate and then curing the ammonia.

15 Claims, No Drawings

FABRIC TREATMENT PROCESSES

This application is a continuation of application Ser. No. 07/518,224, filed May 3, 1990, (abandoned); which is a continuation of Ser. No. 07/379,657 filed Jul. 11, 1989 (abandoned); which is a continuation of Ser. No. 07/256,077 filed Sep. 29, 1988 (abandoned); which is a continuation of Ser. No. 07/107,787 filed Oct. 13, 1987 (abandoned).

This invention concerns fabric treatment processes, in particular, ones involving flame retarded fabric.

Cotton fabrics have been flame retarded by impregnation with tetra kis (hydroxymethyl) phosphonium (THP) compounds or precondensates thereof followed by curing with heat or ammonia. The fabrics have flame retardant properties which are resistant to washing. However, their other physical properties, in particular crease resistance and shrinkage, are often worse, limiting their use as easy care fabrics for use, e.g. in clothing.

In an attempt to overcome these limitations work was done at the Southern Regional Research Center involving treatment of the THP cured fabric with a resin followed by heat cure (Rowland and Mason, Textile Research Journal 1977 pages 365–71 and 721–8).

We have now discovered a process for obtaining a flame retardant fabric having also an improved combination of strength and easy care properties.

The present invention provides a process for the treatment of a cellulosic fabric, wherein a cellulosic fabric, which has already been reacted with a non self-condensing methylolamide having at least two methylol groups (which may optionally have been alkylated) under aqueous acid conditions, e.g. at a pH less than 3, is treated with tetra kis (hydroxymethyl) phosphonium compound or condensate thereof, which is then cured.

The fabric may have been impregnated with an aqueous solution of a THP salt mixed with a nitrogen compound condensable therewith such as melamine or methylolated melamine or urea, or with a solution of a precondensate of said salt and nitrogen compound, or with a solution of THP salt or at least a partly neutralized THP salt, e.g. THP hydroxide, with or without the nitrogen compound, and then the impregnated fabric dried and is cured by heat and/or ammonia. Preferably the fabric is impregnated with a solution of a precondensate of THP salt, e.g. chloride or sulphate and urea in a molar ratio of urea to THP of 0.05–0.8:1, e.g. 0.05–0.6:1, e.g. as described in U.S. Pat. No. 2983623 or 4078101, and cured with ammonia, e.g. as described in U.S. Pat. No. 4145463, 4068026 or 4494951. After the cure, the fabric is usually post treated by. oxidizing with hydrogen peroxide, rinsing and neutralizing and further rinsing. The fabric is then dried. The cured fabric usually carries a loading of 8–25%, e.g. 8–20% or 14–20% of cured THP polymer (based on the weight of untreated fabric), lighter fabrics carrying higher loadings than heavier ones.

Before the THP treatment, the fabric has been impregnated and reacted with an aqueous solution of a non self-condensing methylolamide having at least 2 methylol groups or optionally an alkyl ether thereof. These methylolamides, which are also known as "reactant resins", essentially do not self-condense under the conditions of their reaction or cure with the cellulose on the fabric. The compounds are usually free of N-H groups, except to the small extent to which such groups may be present in dissociation products in equilibrium with said compounds. These methylolamides are preferably methylolated cyclic ureas or 0-alkylated derivatives thereof. Such compounds may be of the formula $$Z—N(R')—CO—N(R^2)—Z$$

in which each Z group represents a $CH_2OH$ or $CH_2OR$ group, wherein R is alkyl, e.g. of 1–6 carbon atoms such as methyl and R' and $R^2$, combined form a divalent aliphatic group which with the 2 nitrogen atoms and the carbonyl group give a 5, 6 or 7 membered ring. The divalent aliphatic group may be of formula $—CR^3R^4—(Y)_n—CR^5R^6—$, in which each of $R^3$, $R^4$, $R^5$ and $R^6$ which may be the same or different represents a hydrogen atom or hydroxyl group or alkoxy group, e.g. of 1–6 carbon atoms such as methoxy, n is 0, 1 or 2, preferably 0 or 1, and Y is an oxygen atom, or $NR^7$ group where $R^7$ is an alkyl group, e.g. of 1–6 carbon atoms such as methyl, or a $CR^8R^9$ group, where each of $R^8$ and $R^9$ which may be the same or different represents a hydrogen atom or alkyl group, e.g. of 1–6 carbon atom such as methyl or hydroxyl group or alkoxy group, e.g. of 1–6 carbon atoms such as methoxy with the proviso that 2 or more hydroxy or alkoxy groups represented by $R^3$–$R^6$, $R^8$ or $R^9$ have to be attached to different carbon atoms and that when n is 2, at least one group Y is a $CR^8R^9$ group.

Thus the divalent aliphatic group with the free valencies two atoms apart, can be of 2–6 carbon atoms, e.g. a 1,2-ethylene group—$CH_2$—$CH_2$ or a -1,2-dihydroxy ethylene group —CH(OH)—CH(OH)—. The divalent aliphatic group with the free valencies three atoms apart can be of 3–10 carbon atoms, e.g. a 1,3-propylene group optionally with at least one hydroxyl or alkyl (e.g. methyl) or methoxy substituent, e.g. on the 2 or 3 numbered carbon atom as in the groups $—CH_2—CR^8R^9—CHR^6—$where $R^8$ is hydrogen or methyl, $R^9$ is hydrogen or hydroxyl or methyl and $R^6$ is hydrogen or methyl or methoxy. The divalent aliphatic group with the free valencies three atoms apart can also be of 2–6 carbon atoms of formula $—CHR^3—O—CHR^5$ or $—CHR^3—NR^7—CHR^5—$where $R^3$ and $R^5$ are as defined above but are preferably hydrogen atoms. The divalent aliphatic group with the free valencies four atoms apart can be of 4–10 carbon atoms, e.g. a -1,4-butylene group, optionally with at least one hydroxyl or alkyl (e.g. methyl) or methoxy substituent.

In another type of methylolated cyclic urea, the groups $R^1$ and $R^2$ above combined represent a tetravalent aliphatic group such that they together with the nitrogen atoms and carbonyl groups of two Z—N—CO—N—Z groups form two fused 5, 6 or 7 membered rings. Such tetravalent groups are usually of formula $—CR^3—(Y)_n—CR^5—$, where $R^3$, $R^5$, Y and n are as defined. Preferably n is 0 and the group is the acetylenyl group of formula $$—\underset{|}{CH}—\underset{|}{CH}—.$$

Examples of the methylolated cyclic ureas are dimethylol ethylene urea and especially 1,3,N,N, dimethylol, 4,5 dihydroxy ethylene urea, but also, dimethylol propylene urea and its 4 methoxy 5,5 dimethyl and 5 hydroxy analogues and the 5 oxa and 5-alkylimino analogues of dimethylol propylene urea and tetramethylol acetylene di urea.

The fabric is impregnated with an aqueous solution of the methylolamide, e.g. one containing 40–250g/l such as 80–180g/l especially 110–180g/l of methylolamide, at an acidic pH, usually of less than 3, e.g. 1–2 or especially less than 1. The pH of the solution of methylolamide is usually adjusted with acid, particularly for low temperature curing, e.g. at less than 50° C.; mineral acids such as hydrochloric or especially sulphuric acid are preferred. The larger the amount of added acid the higher the cure rate or the higher the degree of cure; the impregnation solution is usually 0.1–10, e.g. 0.5–10, preferably 1–6 such as 1–4 or 4–6 N in acid. The solution may contain added soluble salts, e.g. of mono-, di- or trivalent metals and anions from strong acids, such as chlorides, nitrates and sulphates in amounts of 2–200, e.g. 2–50 or 10–200 g/l, e.g. 10–70 such as about 50 g/l; examples of salts are those of ammonia, e.g. ammonium chloride, alkali aetals, alkaline earth metals such as magnesium and zinc and aluminium and the salts may increase the cure rate. Amount of zinc salts, e.g. zinc nitrate, may be 2–20 g/l and amounts of magnesium salts, e.g. magnesium chloride, may be 10–50 g/l. The solution may contain a wetting agent such as a nonionic and/or anionic one, in amount, e g. of 0.1–5 g/l of the solution and may also contain an optical brightener, stable to the acid conditions, e.g. in amount of 10–30 g/l of the solution.

Particularly for high temperature curing, e.g. at above 50° C., there may be used in the methylolamide aqueous solution those soluble salts described above giving acid solutions in water especially when the pH of the impregnant solution is to be adjusted to 2–6, e.g. 3–6. A water-soluble carboxylic acid. e.g. of 2–6 carbon atoms and usually 1–3 hydroxyl groups, such as glycollic, citric, malic, lactic, tartaric and mandelic acids can be used in amounts of e.g. 3–100 g/l, such as 10–70 g/l as well as or instead of the above soluble salt in such processes.

The fabric is impregnated with the solution and the wet fabric usually squeezed to wet pick up of 50–120%, e.g. 60–110% (based on the dry weight of the fabric). Alternatively, the solution may be applied by a minimum add-on technique to give a wet pick up of only 10–50%. The dry weight pick up of the methylolamide is usually 4–25% e.g. 6–18%, such as 8–14% (on the same basis). The fabric may then be cured when it has a moisture content of 6–90% such as 30–90%, e.g after the above squeezing, or when it has a moisture content of 6–30%, e.g. the fabric after minimum add-on as such or after drying, or the squeezed fabric after partial drying. Preferably the moisture content of the fabric at the start of cure is 30–90%, e.g. 30–60% or 45–80%, but especially 60–90%, especially 70–90% (based on the original weight of the fabric) as such higher initial moisture contents enable the THP treatment to be more effective to obtain fabrics with better fire retardant properties than those made from fabrics cured with methylolamide under 6–30% moisture conditions.

The moisture content of the fabric at the start of the cure can be calculated from the weight of the impregnated fabric at that time, the original weight of the fabric and its moisture content (obtained from the loss of weight on drying), the concentration of solids and water in the impregnation solution and the wet pick-up.

The presence of the aqueous solution on the fabric swells it and then in the cure, the fabric reacts with the methylolamide to form a cured fabric in which the methylolamide is cured onto the fabric, e.g. by bonding to the cellulose, e.g. cross-linking the cellulose. Aqueous medium is present on the fabric during and throughout the cure, so that at the end of the cure there is a cured fabric impregnated with aqueous medium and therefore still swollen. Such a cure can be called a moist or wet cure, as distinct from dry cure in which the wet impregnated fabric is dried to remove its moisture and produce a collapsed impregnated dry fabric and then the cure is performed on that dry fabric.

If the moisture content of the fabric at the start of curing is 6–30%, the aqueous solution of methylolamide impregnated on the fabric is usually at pH 1–3, preferably at pH 1–2. The fabric is usually allowed to stand at a temperature of less than 50° C., e.g. 10–40° C. and preferably at ambient temperatures such as 15–40° C. for 5–50 hr, e.g. 10–30 hr and especially 15–30 hr, while precautions are taken not to allow its moisture content to change outside the above quoted range, 6–90% but preferably 6–30%, e.g by wrapping it in a plastic sheet. If desired the fabric may be cured at 50–180° C. for 1 min. to 6 hours, e.g. at 90–140° C. for 2–20 mins, though temperatures of 140–180° C. may be used, again in all cases with thorough precautions taken to maintain the moisture content within the quoted range throughout the cure, e.g. with steam cure in a chamber, under pressure if necessary, and preferably with saturated steam. Under these higher temperature conditions, the pH of the solution on the fabric may be 2–6, preferably 3–5 for fabrics to be heated at e.g. above 90° C. and 2–3 for those heated at 50–90° C. The time, pH and temperature are usually chosen to maximize the cure rate but minimize any tendering of the fabric under the acidity time and temperature conditions.

If the moisture content of the fabric is 30-90%, e.g. 30–60% or 40–75% such as 45–65% at the start of the curing then the pH of the aqueous impregnant solution on the fabric is usually less than 1 and the fabric is allowed to stand for times and temperatures (particularly at less than 50° C.) and under conditions otherwise within the ranges given for the curing of drier fabric. The moisture content is maintained in the 6–90% range, e.g. 30–90% range, during the cure. If a large amount of acid has been added to the impregnation solution, e.g. to give an acid strength in the bath of 3–10 N, such as 4–6 N, then cure times may be reduced to 1 min to 5 hr. such as 0.5 to 4 hr. at ambient temperature such as 15–40° C.

The fabric may be cured without externally applied tension or compression. Preferably the impregnated fabric is cured under conditions of tension in at least one of the warp and weft directions, e.g. those tensions resulting from externally applied forces and/or from internal forces in the fabric. Thus in a continuous process in which impregnated fabric is passed from the impregnation bath, preferably through a squeeze roller, and thence to a take-up roller for curing, the fabric may be wound onto the take-up roller under conditions of tensions at least sufficient to prevent sagging of the fabric and preferably that tension is substantially retained in the fabric on the take-up roller during cure; that tension may even increase during cure. The impregnated fabric may also be applied to the take-up roller under high tension which is at least maintained during curing but preferably the fabric is applied under the minimum tension to prevent sagging. Preferably if the impregnated fabric is not dried, it is advisable during the cure to take measures to prevent drainage of the liquid through the roll. e.g. by rotating the roll slowly without significant loss of moisture; if desired the fabric may be re-rolled to reduce retention of tensions in the fabric. The fabric is also cured usually when free of creases unless a special effect, e.g. pleating, is required. In a high speed cure process, e.g. with cure time less than 30 mins. the curing may be done in a steam chamber under conditions of tension, again preferably under the minimum tension to prevent sagging.

After the curing the fabric is rinsed, neutralized and rerinsed prior to squeezing and drying. The solids add on in the resin treatment is usually 1-6%, especially 2-4%.

Compared to the properties of methylolamide wet cured fabric the post THP treatment drastically increases the flame retardance and may also increase the wet and dry crease recovery angle, increase the moisture regain (or equilibrium moisture content after conditioning) and decrease the moisture content after centrifuging (water inhibition). Compared to fabric containing THP cured polymer, the pre methylolamide cured post THP cured fabric usually has reduced shrinkage after washing and increased wet and dry crease recovery angle. The degrees of retention of tear strength in the treated fabric compared to THP fabric without methylolamide pretreatment are usually much greater than has been found in treated fabrics in which the THP fabric has been treated with methylolamide and heat cured and hence the fabrics treated by the process of the of the invention may have a longer life than the latter involving heat cure.

In order to reduce the loss in tear strength of the treated fabric compared to original fabric before treatment, there may be applied to the fabric having cured THP and cured methylolamide, before or after the final drying step, a softening agent in amount of 0.1-5% by weight (based on the weight of the fabric); examples of such softening agents are condensation products of fatty acids, e.g. of 8-20 carbon atoms and polyamines or cyclization products thereof, each in the form of its protonated or quaternary salts, and also quaternary ammonium salts with 2 fatty aliphatic groups, e.g. 8-20 carbon alkyl and 2 short chain alkyl groups, e.g. of 1-6 carbons such as methyl.

We have also discovered that with the THP cured methylolamide cured fabric a mechanical shrinkage, e.g. mechanical compressive shrinkage of the fabric significantly reduces the progressive shrinkage of the fabrics after many repeat washes. This compressive shrinkage usually involves the following steps; wetting of the fabric with water and/or steam to give a swollen fabric, adjusting the width of the swollen fabric to the desired dimension, compressively shrinking the fabric, and drying the fabric. The compressive shrinkage may be via intimate contact with a stretched elastomeric blanket and maintenance of that contact while the degree of elongation of blanket is reduced, e.g. to zero. Drying may be achieved under restrained conditions, e.g. by compressing the moist shrunk fabric between a heated metal cylinder and an absorbent fabric belt. Finally the fabric may be plated or rolled. An example of such a process is the Sanforized process as described in International Textile Bulletin Dyeing/Printing/Finishing 2/86 pp 14, 16, 20, 22 and 27. The result of the combination of the steps of methylolamide treatment before THP treatment, followed by the mechanical shrinking is that the difference in dimensions, e.g. in the warp direction, between those of the finished fabric and those after one wash can be small, e.g. less than 2.5% or 2%, or very small, e.g. less than 1% and that the degree of progressive shrinkage thereafter on subsequent washing, e.g. 50 times can be small, e.g. less than 5%, or especially very small, e.g. less than 2 or 1%. If the degree of mechanical shrinkage put onto the fabric is more than sufficient to compensate for shrinkage in one wash of the fabric, the THP and methylolamide cured fabric after mechanical shrinkage can extend after one wash by, e.g. up to 5% and that degree of extension can remain substantially unchanged over the next 50 washes, so that the degree of progressive shrinkage is very small. If desired the mechanical shrinking operation may be performed in the pre methylolamide treatment process, before THP cure and after the methylolamide reaction instead of or as well as after the latter reaction. The mechanical shrinking operation is usually performed after the last cure step and may be performed between the cure steps.

The fabric usually has a majority of cellulosic fibres and is preferably 100% cellulosic as preferably in natural cotton but also in ramie, flax or regenerated fibres, e.g. viscose or cuprammonium rayon fibres. The fabric may have been mercerized with aqueous alkali or liquid ammonia, optionally with amines, after or preferably before application of the methylolamide. The cellulose fibres are especially woven but may be knitted. They may also be mixed with an amount, e.g. a minority amount, e.g. up to 50% such as 1-50% of coblendable fibres such as polyester fibres to make, e.g. blends of 60-80% cotton with 20-40% polyester. However the process is of particular application to substantially completely cellulosic weight of 0.05-1.00 kg/m$^2$ such as 0.1-1.00 kg/m$^2$, usually 0.15-0.40 kg/m$^2$, and preferably 0.23 to 0.37 kg/m$^2$; examples of such fabrics are cotton drill fabric or sheeting, shirting or curtain fabric.

The fabric before THP or methylolamide treatment may have been dyed, e.g. with vat or azoic dyes, though basic, reactive, direct, acid or disperse dyes may also be used. If the fabric is to be dyed after THP treatment, reactive dyes are preferred. If the fabric is to be dyed before methylolamide treatment, then dyes such as vat and azoic ones are preferred. With some shades of vat or azoic dyes it may be better to treat and react with methylolamide first then dye, and then treat with THP compound and then cure.

The treated fabrics with the flame retardant and easy care properties may be used in uniforms, e.g. for security guards and for the fire brigade and for workwear. Lighter fabrics may be formed into uniform shirts for which durable press ratings and easy care properties are particularly important and heavier fabrics, e.g. cotton drill fabrics, may be formed into workwear such as overalls and trousers for which lack of shrinkage is particularly important.

The invention is illustrated in the following Examples in which the following test methods were used. In every case the fabric was conditioned to 20° C. and 65% Relative Humidity for 24 hours before testing.

1. Crease recovery

Both dry and wet crease recovery angles were measured compared to the untreated fabric using the MONSANTO WRINKLE RECOVERY TESTER with a 500g load and 3 minute load/recovery/times, in the Warp direction and creased with the face outwards.

2. Durable press rating (D.P.)

The fabric was assessed using the AATCC Test Method No. 88 wash and wear standards and DP ratings based on the smoothness appearance of the fabric compared to standards 1-5 (1 being the poorest rating).

3. Shrinkage

Warp and weft shrinkage were measured according to the procedure of BS 4923 (1973) after the fabric had been washed 1 and 50 times (in the manner described in DIN 53920 with soft water) at 93° C.

4. Strength

Tensile strength was measured according to BS 2756 and the tear strength in the weft direction (according to Elmendorf) was also determined.

5. Flame Retardancy

The flame retardancy of the fabric was tested as finished and after 50 washes at 93° C. (the washing being as in the manner described in DIN 53920 with soft water). The test method used was according to BS 3119.

EXAMPLES 1 and 2

Fabric

Pieces of 3111 loomstate drill cotton fabric of weight 0.295 kg/m$^2$ were enzymically desized, scoured with alkali and bleached with alkaline hydrogen peroxide. From the bleached fabrics of weight 0.27kg/m$^2$ were obtained one 50m length which was submitted to process operations in the following order, treatment and cure with methylolamide, then treatment and cure with THP compound, and then mechanical compressive shrinking for Examples 1 and 2, and a second 50m length which, for comparison purposes, was treated and cured with THP compound and then mechanical compressive shrinking for Comparative Examples 3 and 4.

Methylolamide Cure Step

The above fabric was passed continuously twice through a padding solution which contained 325g/1 of a 45% aqueous solution of di 1,3,N,N-aethylol 4,5-dihydroxy ethylene urea (sold under the Trade Mark FIXAPRET CPN) (DMDHEU), 90g/1 of 98% sulphuric acid to give a pH of less than 1 and an acid concentration in the solution of 1.84 N and 2g/l of a wetting agent which was a mixture of nonionic and anionic ones sold under the mark WA100 by. Brookstone Chemical, Staffs. England, and 18g/l of a fluorescent brightening agent stable to acid sold by Sandoz as Leucophor BCR liquid. The wet pick-up was 100% and the moisture content of the fabric 79% (based on the original weight of the fabric). The fabric was then, under conditions of minimum tension, passed onto a roll, was wrapped in a plastic sheet and the roll rotated slowly at room temperature (18° C.) for 22 hours to cure the DMDHEU. The cured fabric was then washed with water, then neutralized and then rewashed with water in a jig dyeing machine, followed by a softening step in which the fabric was passed three times through a softening bath at 40° C. containing 10g/l of a nonionic fatty ester derivative softening agent sold by Crosfield Textile Chemicals as CROSOFT XME. The wet fabric was then sucked dry and then dried by heating at 150° C. in a stenter.

THP Cure Step

The fabric, which had been methylolamide cured in Examples 1 and 2 and was the bleached fabric in the case of Comparative Example 3, was impregnated with an aqueous solution at pH 4.5 of a precondensate of THP chloride and urea in a molar ratio of 1:0.5 and in an amount in the solution corresponding to 25% THP ion to an about 80% wet pick up, the impregnated fabric was dried at 120° C. for 1 minute and then cured with gaseous ammonia in a forced gas ammoniator as described in U.S. Pat. No. 4145463. The cured fabric was oxidized with hydrogen peroxide, neutralized with sodium carbonate solution, rinsed and dried.

Mechanical Compression Shrinkage Step

The fabric was mechanically compressively shrunk on a "Sanforizer" classic machine as described in International Textile Bulletin Dyeing/ Printing/Finishing 2/86 pp 14,16, 20, 22 and 27 involving initial steaming, adjustment of width, pressing against a stretched rubber blanket which was then allowed to relax resulting in shrinking of the fabric, followed by drying by compressing the fabric between a heated metal cylinder and an absorbent blanket and rolling. The degree of shrinkage set on the machine was 5%.

Results

Properties of the Fabrics obtained after each of the above steps.

In the Table of results below Examples 1 and 2 and Comparative Examples 1-4 refer to the fabrics obtained according to the following operations.

| Example | Summary of Operation |
|---|---|
| 1 | DHDMEU, THP |
| 2 | DHDMEU, THP, Mech. shrink |
| Comp. 1 | DHDMEU only |
| Comp. 2 | Original bleached Fabric |
| Comp. 3 | THP only |
| Comp. 4 | THP, Mech. shrink |

1. Shrinkage

| | % Shrinkage after given number of wash cycles | | | |
|---|---|---|---|---|
| | 1 | | 50 | |
| Example | Warp | Weft | Warp | Weft |
| Comp. 4 | 1.0 | 2.8 | 7.3 | 5.9 |
| Comp. 3 | 3.9 | 3.5 | 12.4 | 8.8 |
| Comp. 2 | — | — | 12.8 | 5.6 |
| Comp. 1 | 1.2 | 2.2 | 2.3 | 2.5 |
| 1 | 2.0 | 2.4 | 6.3 | 4.0 |
| 2 | +3.1 | 2.1 | +2.4 | 2.5 |

NB A positive sign, e.g. +3.1% denotes an extension on washing rather than a shrinkage.

2. Tear Strength in the weft direction according to Elmendorf

| | Strength (kg) | |
|---|---|---|
| Example | Warp | Weft |
| Comp. 4 | 3.00 | 3.00 |
| 2 | 2.40 | 2.20 |

3. Tensile Strength according to BS 2756

| | Strength (Newtons) | |
|---|---|---|
| Example | Warp | Weft |
| Comp. 4 | 1262 | 751 |

-continued

| Example | Strength (Newtons) Warp | Weft |
|---|---|---|
| 2 | 1014 | 580 |

4. Flame retardancy tested as described above after 50 washes

| Example | Average Length (mm) |
|---|---|
| Comp. 4 | 60 |
| 2 | 53 |

5. Crease Recovery Angles

| Example | Wet (°) | Dry (°) |
|---|---|---|
| Comp. 4 | 95 | 70 |
| Comp. 2 | 65 | 90 |
| Comp. 1 | 130 | 90 |
| 2 | 135 | 100 |

6. DP rating assessed as specified above after single wash at 95° C. and drying according to the following procedure Squares of the fabric were washed in a washing machine at 95° C. for 10 minutes, then with 3 cold water rinses and the fabric spun for 4 minutes at 1000 rev. per. min. The fabric squares were then dried with the aid of pegs on a line at room temperature or tumbledried for 15 minutes with a final maximum temperature of 70° C.

| Example | DP Rating Line Dry | Tumble Dry |
|---|---|---|
| Comp. 4 | 2 | 2 |
| Comp. 2 | 1-2 | 1-2 |
| Comp. 1 | 3-3.5 | 3-3.5 |
| 2 | 3 | 3 |

7. Moisture content

The moisture contents of the Fabrics of Comparative Example 4 and Example 2 after conditioning for 24 hours at 65% RH were assessed by drying the conditioned preweighed fabrics for 2 hours at 105° C. and then reweighing. The moisture content of the Fabrics from Comparative Example 4 were 0.5-1% less than those of Example 2. Thus the pretreatment with DHDMEU increased the moisture regain at 65% RH.

8. Water Inhibition

The fabrics of Example 2 and Comparative Example 4 were given an HLCC 1 wash in a Servis Quartz machine and the water retained after spinning the wet fabrics at 1000 rpm for 4 min was determined. The pretreated Fabrics of Example 2 retained 22% less water than the fabrics of Comparative Example 4, so the pretreatment reduced the moisture inhibition.

We claim:

1. A process for the treatment of a cellulosic fabric comprising reacting said fabric under aqueous acid conditions at a pH of less than 3 with a non self-condensing methylolamide having at least two methylol groups or an alkylated non self-condensing methylolamide having at least two methylol groups, contacting the resultant fabric with a tetrakis (hydroxymethyl) phosphonium compound or condensate thereof and curing the compound or condensate thereof.

2. The process according to claim 1, wherein the curing is carried out with ammonia.

3. The process according to claim 1 or 2, wherein the methylolamide is in an aqueous solution at a pH of less than 1.

4. The process according to claim 1, wherein the fabric has a moisture content of 6-90% when reacted with the methylolamide.

5. The process according to claim 4, wherein the pH is less than 1 and the fabric has a moisture content of 30-90%.

6. The process according to claim 5, wherein the fabric has a moisture content of 60-90%.

7. The process according to claim 6, wherein the methylolamide is reacted with the fabric in an aqueous medium 12-6 N in acid.

8. The process according to claims 1, 5 or 6, wherein the methylolamide is a methylolated cyclic urea or O-alkylated derivative thereof.

9. The process according to claims 5, 6 or 7, wherein the methylolamide is 1,3, NN-dimethylol- 4,5- dihydroxyethylene urea.

10. The process according to claim 5 or 6, wherein the fabric is treated with an aqueous solution of a condensate of a tetrakis (hydroxymethyl) phosphonium compound and urea and then cured with gaseous ammonia.

11. The process according to claim 1, wherein the fabric is made of cotton fibres or a mixture thereof with up to 50% by weight of fabric of polyester fibres.

12. The process according to claim 1, wherein the dry weight pick-up of methylolamide on the fabric is 6-20% and of cured product from tetrakis (hydroxymethyl) phosphonium compound or condensate is 8-20%.

13. The process according to any one of claims 5, 6 and 7, wherein the methylolamide is reacted with the fabric, while the fabric is maintained under tension in at least one of the weft and warp directions.

14. The process according to claims 5, 6 or 7, further comprising after the curing of the tetrakis (hydroxymethyl) phosphonium compound or condensate thereof, subjecting the fabric to mechanical compressive shrinkage.

15. The process according to claims 1, 7, 11 or 12, wherein the fabric comprises cotton fibres, which are impregnated with an aqueous solution of 1,3 N,N dimethylol 4,5 di-hydroxyethylene urea, said fabric being reacted under aqueous conditions of a pH of less than 1 and 1-4 N in acid with a moisture content of the fabric of 30-90%, then treated with an aqueous solution of a condensate of tetrakis (hydroxymethyl) phosphonium compound and urea and cured with gaseous ammonia, followed by mechanical compressive shrinkage of the fabric obtained.

* * * * *